US005303003A

United States Patent [19]

Jamzadeh

[11] Patent Number: 5,303,003

[45] Date of Patent: Apr. 12, 1994

[54] COLOR TRANSPARENCY HAVING TONER IMAGES TRANSFERRED TO BOTH SIDES AND METHOD OF MAKING

[75] Inventor: Fereidoon S. Jamzadeh, Fairport, N.Y.

[73] Assignee: Eastman Kodak Company, Rochester, N.Y.

[21] Appl. No.: 832,129

[22] Filed: Feb. 6, 1992

[51] Int. Cl.[5] ..... G03G 15/00; G03G 21/00; G03G 15/01

[52] U.S. Cl. ..... 355/200; 355/77; 355/326

[58] Field of Search ..... 355/200, 271, 326, 327, 355/274, 77

[56] References Cited

U.S. PATENT DOCUMENTS

| | | | |
|---|---|---|---|
| 3,132,963 | 5/1964 | Jarvis | 117/17.5 |
| 3,292,486 | 12/1966 | Mey | 355/326 |
| 3,536,398 | 10/1970 | Bhagat | 355/271 |
| 3,580,670 | 5/1971 | Bhagat | 355/271 |
| 3,697,171 | 10/1972 | Sullivan | 355/274 X |
| 3,734,015 | 5/1973 | Camis et al. | 355/274 X |
| 3,936,171 | 2/1976 | Brooke | 355/271 |
| 3,973,846 | 8/1976 | Sullivan et al. | 355/271 |
| 4,345,012 | 8/1982 | Hirsch et al. | 430/48 |
| 4,962,386 | 10/1990 | Hakkaku et al. | 346/1.1 |
| 4,994,827 | 2/1991 | Jamzadeh et al. | 355/326 X |
| 5,030,538 | 7/1991 | Tobias et al. | 430/138 |
| 5,040,029 | 8/1991 | Rodenberg et al. | 355/271 |
| 5,144,328 | 9/1992 | Blake et al. | 346/1.1 |

FOREIGN PATENT DOCUMENTS 02-86468 3/1990 Japan .

*Primary Examiner*—Fred L. Braun
*Attorney, Agent, or Firm*—Leonard W. Treash, Jr.

[57] ABSTRACT

A color tranparency having high density includes overlying color toner images on opposite sides of a transparent substrate. The color images are formed by first forming two sets of electrostatic images, one set being a mirror image of the other. The electrostatic images are toned by application of different color toners to the images of each set and then each set is transferred in registration to opposite sides of the transparency.

1 Claim, 4 Drawing Sheets

LASER SCANNER
OUTPUT LINE BUFFER
LOGIC AND CONTROL UNIT (LCU)
FRAME STORE
DATA PATH CONTROLLER
PRINT FORMAT SELECT
INPUT LINE BUFFER
FROM LCU
FROM LCU
FROM LCU
RI-Rn, GI-Gn, BI-Bn
ON/OFF
RGB
ON OFF
TO S
1
2
3
4
5
6
7
8
9
10
11
12
14
16
17
18
19
20
21
24
25
26
27
41
48
50
52
54
56
E
F
L
P
R
S

FIG. 4
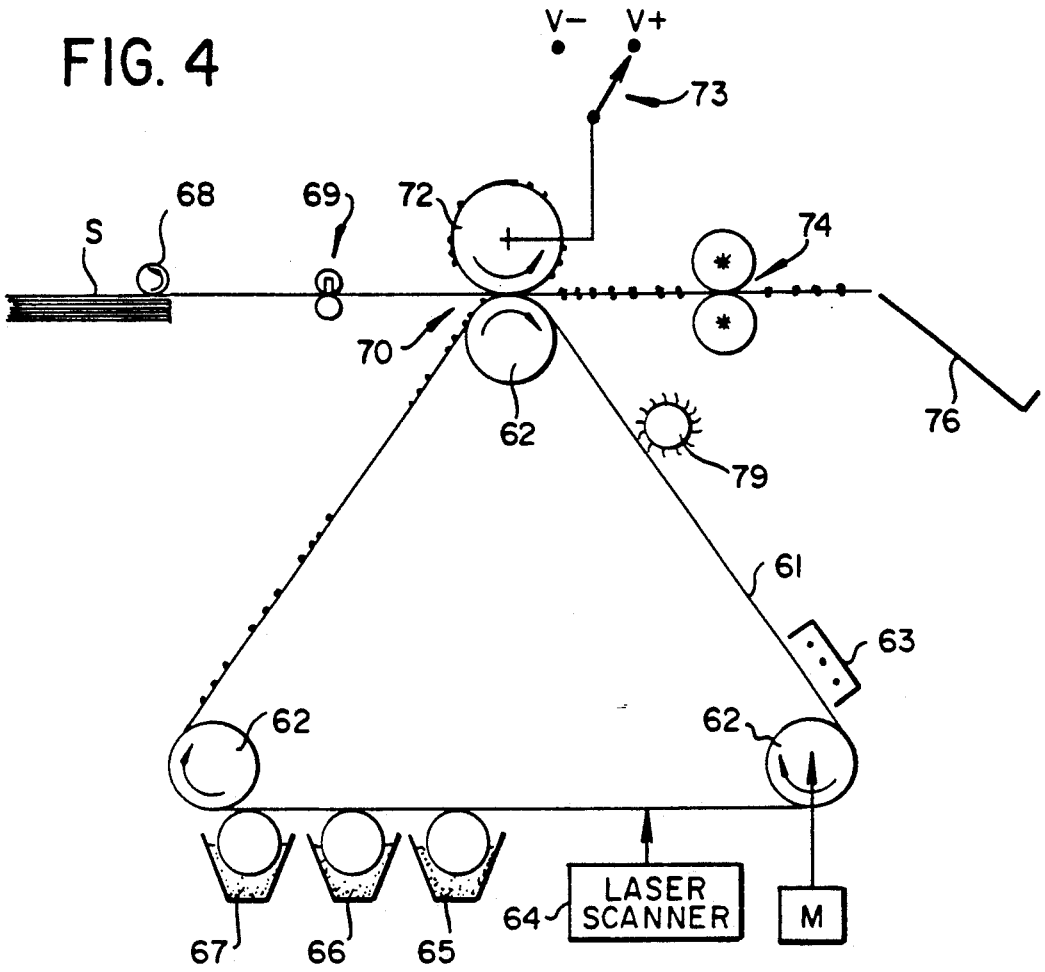
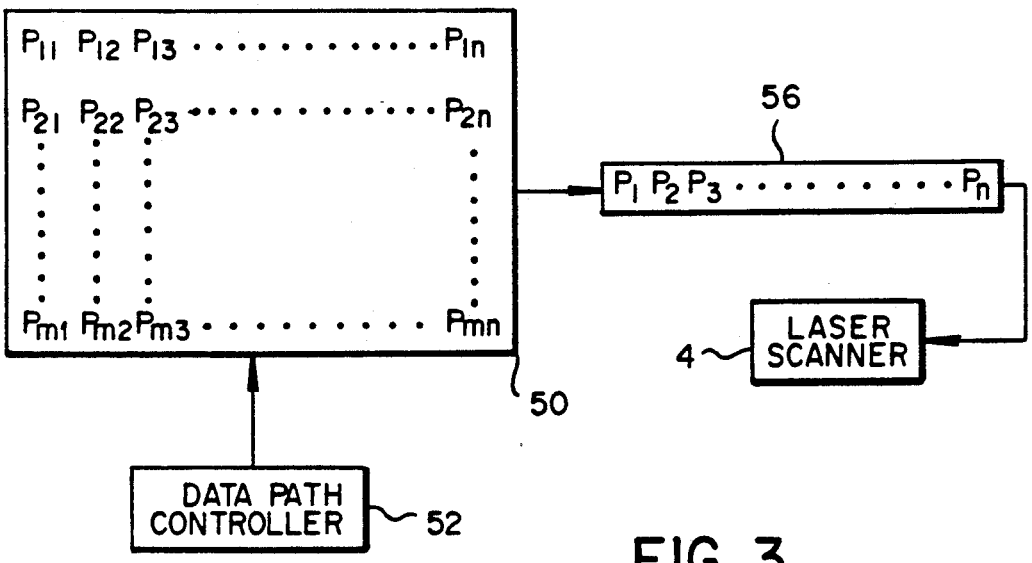
FIG. 3

COLOR TRANSPARENCY HAVING TONER IMAGES TRANSFERRED TO BOTH SIDES AND METHOD OF MAKING

BACKGROUND OF THE INVENTION

1. Field of the Invention

The present invention relates to improvements in methods and apparatus for producing photographic-type transparencies of high density. It also relates to the color transparencies produced by such methods and apparatus.

2. Background Art

In U.S. Pat. No. 4,345,012 issued to Hirsch et for producing high density transparencies of a single color. Such a process involves the steps of forming charge images of identical shape but opposite polarity on opposite sides of a transparent dielectric film, and developing such images with pigmented electroscopic particles of opposite polarity. When viewed through the film, the density of the two developed images add together to provide a denser visible image than might be achieved were the pigment applied to only one side of the film.

According to the disclosure of the above patent, the two charge images of opposite polarity are produced by arranging the transparent film in close proximity to a photoconductive layer having a grounded backing electrode. While an electric field is established across the film, the photoconductive layer is imagewise exposed through the film. While this image-forming process is theoretically possible to perform and is advantageous from the standpoint that the opposing images are in perfect registration, it may be appreciated that this process is difficult to control and to repeat with good results. Moreover, to develop the charge images on the film, access is required to both sides of the film. In the disclosed embodiment, development of the charge images is effected by immersing the entire film in a liquid developer having toner particles of opposite polarity. Over and above these disadvantages, the process disclosed does not lend itself well to automation or to the production of multicolor transparencies.

SUMMARY OF THE INVENTION

In view of the foregoing discussion, an object of this invention is to overcome the above-noted draw backs in the prior art method and apparatus for producing high density transparencies.

Another object of this invention is to provide a novel color transparency.

According to one aspect of the invention, there is provided an improved method for producing a transparency of the type having complementing mirror images on opposite sides of a transparent support, such images collectively defining the density of a single composite image viewable through the support. Such method is characterized by the steps of:

(a) forming first and second transferrable images on an image recording element, such images being mirror images of each other; and (b) transferring the first and second transferrable images in registration to opposite sides of a transparent image-receiving support.

According to another aspect of this invention, there is provided an improved apparatus for producing transparencies of the above type. Such apparatus is characterized by (a) means for forming first and second transferrable images on an image recording element, such images being mirror images of each other; and (b) means for transferring the first and second transferrable images in registration to opposite sides of a transparent image-receiving support.

The method and apparatus of the invention are advantageous in that the developer used to create the transferrable images need not comprise particles of opposite polarity, and access need not be had to both sides of the image recording element. Also, by virtue of forming transferrable mirror images on a recording element and transferring such images to a transparent image-receiving member, a more repeatable process is provided for producing high quality and high density transparencies. Moreover, the process of the invention can be readily automated and lends itself to use in the production of full color transparencies.

According to still another aspect of this invention, there is provided a novel color transparency which comprises a transparent support having registered images of different colors on opposing sides, such images collectively defining a full color composite image which is viewable through the support.

Other objects and advantages of the invention will be apparent to those skilled in the art from the ensuing detailed description of preferred embodiments, reference being made to the accompanying drawings wherein like reference characters denote like parts.

BRIEF DESCRIPTION OF THE DRAWINGS

FIG. 3 illustrates certain circuitry for producing complementary mirror images on an image recording element; and FIGS. 4 and 5 are schematic illustrations of alternative apparatus for producing transparencies.

DETAILED DESCRIPTION OF PREFERRED EMBODIMENT S

Figure 1:
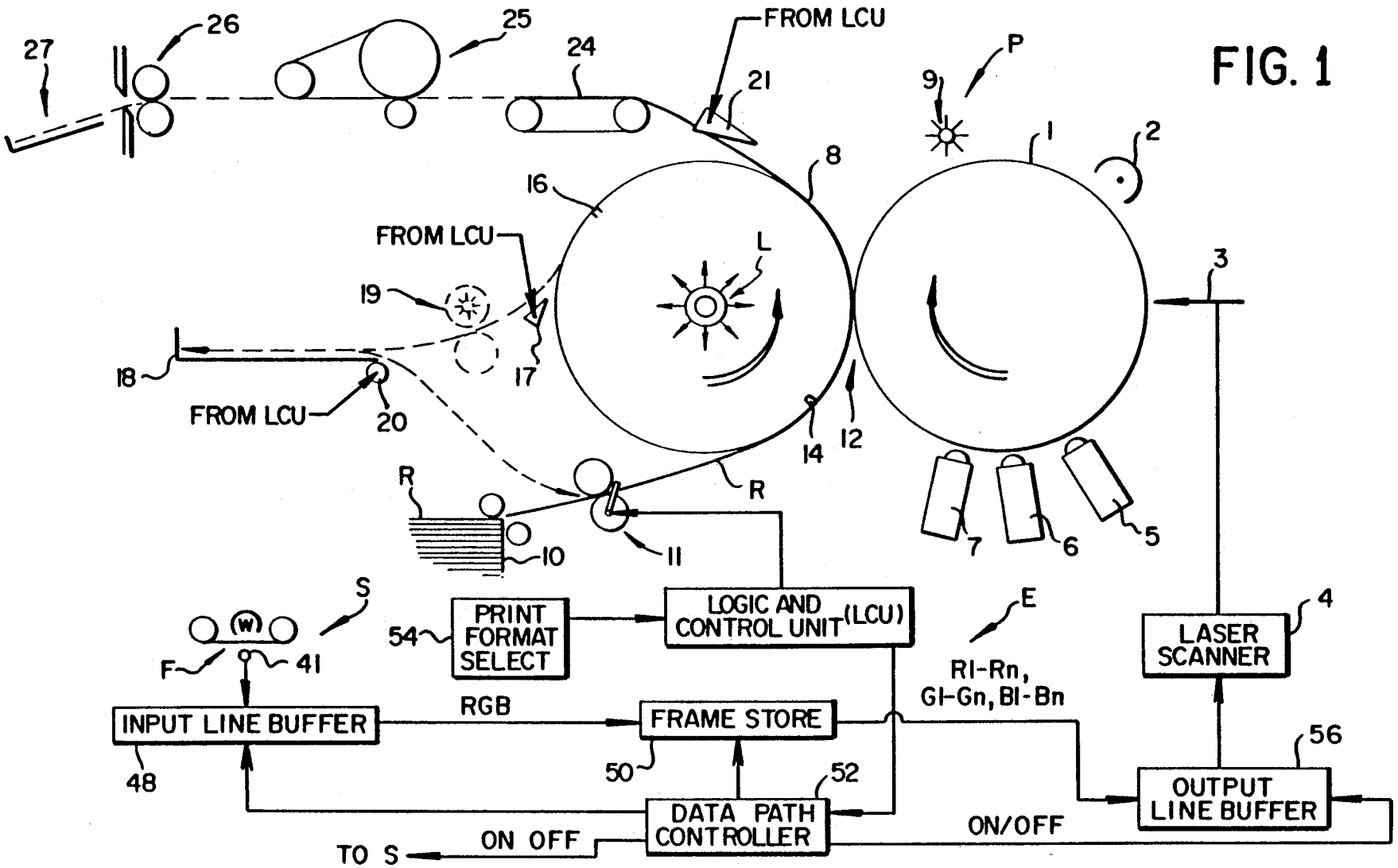
FIG. 1 is a schematic illustration of preferred apparatus for carrying out the method of the invention.

Referring now to the drawings, FIG. 1 schematically illustrates an electrophotographic photofinishing apparatus embodying the present invention. Such apparatus is adapted to electrophotographically produce photographic-type color transparencies on transparent image-receiving sheets R. The latter may comprise, for example, a sheet of polyethylene-terepthalate or Estar, a trademark of Eastman Kodak Company. Preferably, each of the opposing planar surfaces of the transparent sheet bears a thin coating (e.g., between 1 and 100 microns thick) of a transparent thermoplastic material having a melting temperature lower than that of Estar. A suitable material is polystyrene marketed by Goodyear under the trademark Pliotone 2015 which has a glass transition temperature of between 50 and 60; degrees Centigrade. Other suitable materials are disclosed, for example in U.S. Pat. No. 4,968,578, the disclosure of which is incorporated herein by reference.

The apparatus of FIG. 1 generally comprises a film scanner S for producing electrical signals representing the color-separated image information in a linear array of multicolor image frames (e.g., that contained in a 35 mm. photographic filmstrip F), and an electrophotographic color printer P for converting such electrical signals to a plurality of visible color images which, in accordance with the present invention, are formed, in registration, on both sides of the transparent image-receiving sheets R. Suitable electronics E, discussed below, interconnect the scanner and printer, such electronics operating to process the scanner output signal to achieve a desired printing configuration.

Printer P comprises a reusable image-recording element, such as a photoconductive drum 1, which is rotated by a motor, not shown, in a clockwise direction (as viewed in FIG. 1) past a series of processing stations, all well known in the art. Such processing stations include a primary charging station 2 which operates to uniformly charge the photoconductive surface of the drum, and an exposure station 3 for imagewise exposing the uniformly charged surface to produce developable electrostatic images thereon. The exposure station may comprise a conventional LED printhead or, as shown, a laser scanner 4 which operates to repeatedly scan a laser beam in a direction parallel to the drum's axis of rotation. While the drum rotates, the intensity of the scanning laser beam is modulated with color-separated image information to produce a series of electrostatic images on the drum surface, each representing a color-separated image of the ultimately desired multicolor transparency. These electrostatic images are rendered visible with different color toner (e.g., cyan, magenta and yellow toner) applied by development stations 5, 6 and 7 to produce a series of related toner images. As explained below, these color-separated toner images are transferred, in registration, to both sides of a transparent print-receiving sheet carried by a transfer drum 8 to produce a color transparency of considerable density. Following such transfer step, the photoconductive drum is cleaned of residual toner particles at a cleaning station 9 and recycled through the electrophotographic process to record additional transferrable toner images.

Transparent print-receiving sheets R are fed, seriatim, from a sheet supply 10 to a sheet-registration station 11 which operates under the control of a microprocessor-based logic and control unit LCU. The sheet-registration station functions to feed sheets to an image-transfer station 12, defined by a pressure nip formed between the respective surfaces of photoconductive drum 1 and transfer drum 8, in timed relation with the arrival thereat of a toner image on the surface of drum 1. As each sheet approaches the transfer station, it is secured to the surface of the transfer drum by vacuum means, gripping fingers or other suitable mechanisms. For example, the leading edge of the sheet can be secured to the transfer drum by a row of vacuum holes 14, and the trailing edge by a row of vacuum holes 16. During each rotation of the transfer drum, one color-separated toner image is transferred to a receiver sheet. As illustrated, transfer drum 8 is internally heated by a quartz lamp L or the like, and transfer of the toner images from the surface of drum 1 to the receiving sheet is effected by the combination of heat and pressure.

After the transfer drum has made three revolutions and three related color-separated toner images have been transferred, in registration, to one surface of a receiver sheet, the leading edge of the receiver sheet is stripped from the transfer drum 8 by stripping mechanism 17. The latter operates under the control of the LCU to move between sheet-stripping and non-stripping positions. The stripped receiver sheet is pushed by further rotation of the transfer drum into an intermediate sheet-storage tray 18. Optionally, the transferred toner images on the receiver sheet can be fused thereto by a pair of fusing rollers 19, shown in phantom lines. Thereafter, a sheet-feeding roller 20 operates to return the sheet in tray 18 to the sheet-registration station 11 which, at the appropriate time, advances the sheet to the transfer drum surface. Note, at this time, the sheet's opposite surface, i.e., the surface bearing no toner image, is presented to the transfer station 12 to receive, as the drums rotate, a second series of related toner images. As explained below, each of the toner images of this second series is a mirror image of that transferred to the opposite surface. When registered with the previously transferred toner images, the toner images of the second series form a composite image in which the densities of the images on opposite sides of the sheet are additive. In this manner, a much denser transparent image is formed on the image-receiving sheet than could be formed on only one surface thereof.

Upon transferring multiple toner images to the opposing surfaces of the receiving sheet, the sheet is stripped from the transfer drum by a sheet-stripping mechanism 21 which, like stripping mechanism 17, operates under the control of the LCU. The stripped sheet is then advanced by a sheet transport 24 to a fusing station 25 which permanently affixes the toner images to both surfaces of the sheet. Finally, the sheet is advanced to an optional cutting mechanism 26 which, in the event the transferred toner images comprise a plurality of unrelated smaller format images, acts to cut the sheet into a plurality of smaller format transparencies, each containing a single multicolor transparent image. These smaller transparencies are then deposited in an output tray 27.

The input to exposure station 3 is provided by a conventional electronic color scanner S which includes a color-responsive CCD array 41 suitable scanners are disclosed, for example, in U.S. Pat. Nos. 4,638,371 and 4,639,769., the respective disclosures of which are incorporated herein by reference. Scanner S operates to scan an original multicolor image frame, line-by-line and pixel-by-pixel, to produce three color-separated signals R,G and B, representing the color content of each of the scanned image frames in three spectral regions, e.g., the red (R), green (G) and blue (B) spectral regions. These three color-separated signals are produced substantially simultaneously and, as they are produced, they are stored in a conventional framestore 50 via input line buffer 48. The latter serves to buffer a few lines of image data to account for any mechanical latencies at the scanner/framestore interface.

The logic and control unit LCU operates through a data path controller 52 to control the flow of image data into and out of the framestore. It also controls the sequence in which the image data is read out of the framestore so as to cause the laser scanner to record either correct-reading or mirror images on the surface of drum 1. In addition to managing the whereabouts of data in the framestore, the LUC receives inputs from various portions of the apparatus, including encoders on the photoconductive drum and transfer drum and transducers on various processing stations to manage the timing of the entire apparatus. One of such inputs, for example, comes from a print format selector 54 which comprises an operator control panel. By means of selector 54, an operator can choose any one of several different print or transparency sizes, as explained in the commonly assigned U.S. Pat. No. 5,175,628, issued Dec. 29, 1992 the disclosure of which is incorporated herein by reference.

As noted earlier herein, the production of multicolor images on transparent image-receiver sheets R requires that multiple color-separation images be formed on drum 1. The LCU controls the production of such images by causing the data path controller to extract, for example, all the red image pixels (R1–Rn), followed by all the green image piexels (G1–Gn), followed by all the blue image pixels (B1–Bn). These signals are applied to the laser scanner via an output line buffer 56 to modulate the intensity of the scanning laser beam.

Figure 2A:
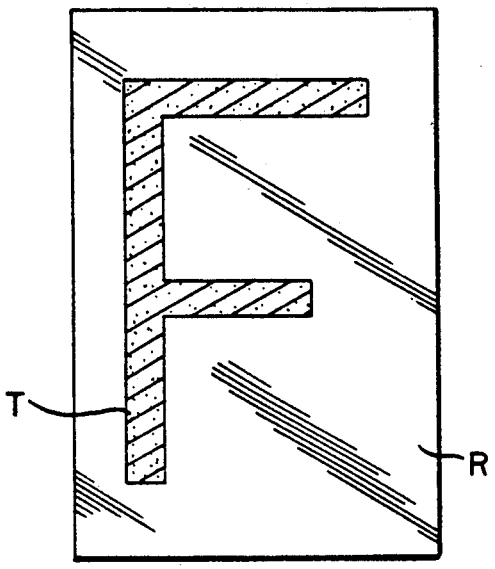
FIGS. 2A–2C illustrate a transparent image-receiving sheet with registered complementing images on opposite sides thereof.
Figure 2B:
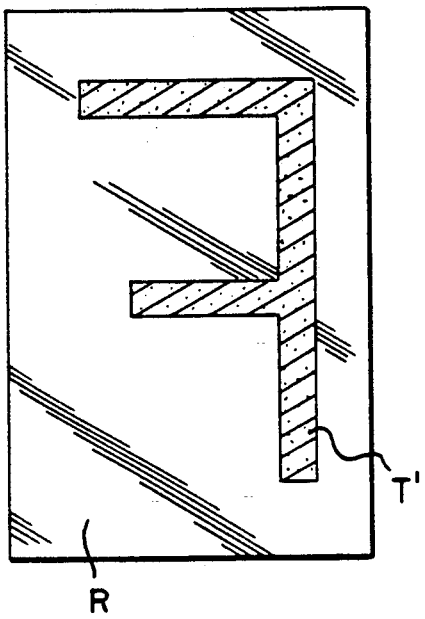
Figure 2C:
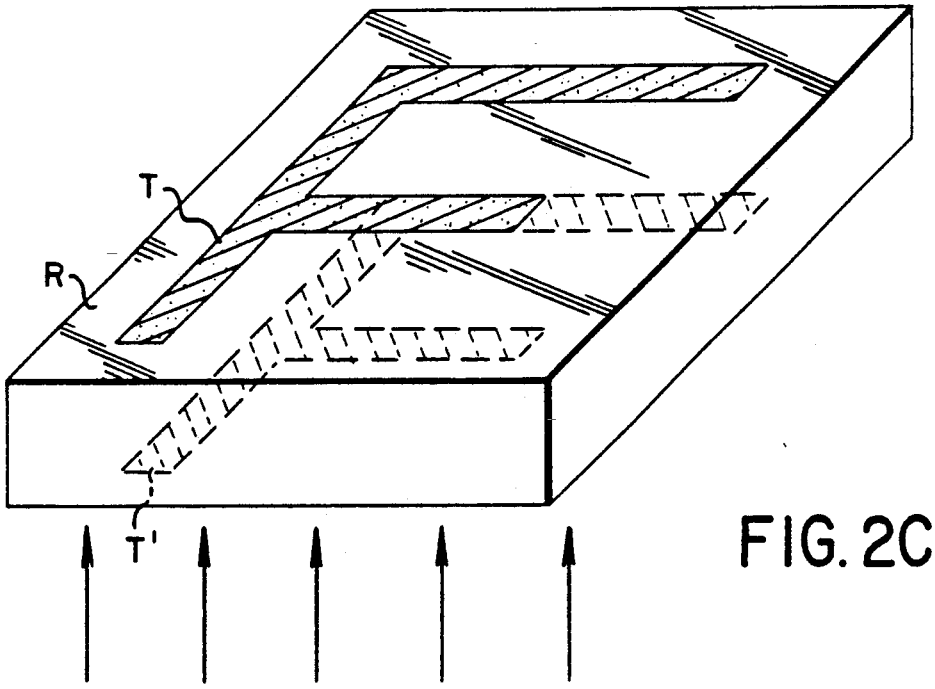

Referring to FIGS. 2A–2C, to produce "complementing" toner images T and T' on opposite sides of receiver sheet R, which images add in density when light is projected through the receiver sheet, it is necessary to successively produce "complementing" toner images on the photoconductive drum 1. By "complementing" images is meant "mirror" images, one image being the mirror image of the other. In the case of a monochrome transparency, for example, a correct-reading toner image is first recorded on drum 1. Upon transferring this toner image to one surface of a receiver sheet, the transferred image is "reverse-reading". A reverse-reading toner image is then recorded on drum 1. Upon inverting the receiver sheet by advancing it into and out of the intermediate tray 18, this subsequently produced reverse-reading image on drum 1 is transferred to the opposite side of the receiver sheet to produce a correct-reading image thereon. Ideally, the transferred correct-reading and reverse-reading images are in precise registration so as to provide a single sharp image which is viewable through the transparent receiver sheet. (Note, it will be appreciated that in viewing the image "through" the receiver, a portion of the image is on the side of the viewer.) Apparatus for achieving the requisite registration between the images formed on the opposing sides of the receiver sheet is well known in the art. See, for example, the registration techniques disclosed in the commonly assigned U.S. Pat. No. 4,963,899 to W. A. Resch III, the disclosure of which is incorporated herein by reference. Preferably, such apparatus should be capable of registering images to within 60 microns of each other, which will result in a very sharp composite image.

FIG. 3 illustrates the organization of Pmn image pixels in a conventional framestore, pixel P11 being the first of n picture elements (pixels) in the first of m rows of pixels, and Pmn being the last pixel in the last row (row m) of pixels. In recording each toner image, the pixels are loaded, line-by-line into the output line buffer 56. After each line is loaded, a line of image information is recorded by the laser scanner. When a correct-reading toner image is to be recorded on the photoconductive drum, the pixels are clocked out of the line buffer in the order P1,P2,P3 . . . Pn. When a reverse-reading image is to be recorded, the pixels are clocked out of the line buffer in the reverse order, Pn, P(n-1), P(n-2) . . . P1. Such clocking out of the pixels is controlled by the LCU via the data path controller 52. Note, when the images are oriented on the recording element so that the top of the image is adjacent one edge of the recording element and the bottom of the image is adjacent the opposite edge of the recording element, the mirror image-forming process is as described above. However, if the images are arranged so that the top and bottom edges are transverse to the direction in which the recording element advances (i.e. parallel to the axis of rotation of drum 1), the image lines are loaded into the line buffer in the reverse order when making the second image. In this manner, the complementing images are not only mirror images of each other, but also upside down with respect to each other. This is necessary to produce the requisite image registration after transfer of the second image.

In making a color transparency using the apparatus described above, each side of the image-receiver sheet can successively receive cyan, magenta and yellow toner images. By varying the order in which the toner images are recorded and transferred, tone reproduction and color balance can be readily changed. For example, for one set of colorants it may be desirable to record toner images in the sequence: cyan, magenta, yellow--cyan, magenta, yellow. For another colorant set, it may be desirable to record images in the sequence: cyan, magenta, yellow--yellow, magenta cyan. Also, for a given set of toner colorants, it may be desirable to produce two toner images of the same color on one side of the receiver sheet, and two toner images of a different color to the other side. Thus, it may be desirable to record toner images in the order magenta, magenta and cyan on one side of the receiver sheet, and cyan, yellow, and yellow on the opposite side. Of course, there are many combinations and permutations that can be used to give different results. This ability to readily change tone reproduction and color balance is a significant advantage of the above-described apparatus and method for producing color transparencies.

Another electrophotographic apparatus for making the two-sided transparencies described above is illustrated in FIG. 4. Here, the photoconductive recording element is in the form of an endless web 61 which is trained about a series of rollers 62, one of which is driven by a motor M to advance the recording element in a clockwise direction, as viewed in the drawings. As the recording element advances along its endless path, it is uniformly charged at charging station 63, and imagewise exposed by a laser scanner 64. The resulting charge image is developed with toner applied by one (or all) of a plurality of development brushes 65–67. Note, in this embodiment, as explained below, there is no need to form mirror images on the recording element, i.e., all images can either be correct-reading, or reverse-reading. In the case of a monochrome transparency, identical charge images are formed on two successive image frames on the recording element. While these images are formed, a transparent receiver sheet S is fed by roller 68 to a registration gate 69 where it waits to be further advanced, in timed relationship with the movement of the second toner image to an image transfer station 70. As the first toner image passes through the transfer station, it is transferred to the surface of an intermediate image receiving drum 72 whose bias, V+or V−, is controlled via through an LCU-controlled switch 73. As the second toner image approaches the transfer station, the receiver sheet is advanced to the nip between the transfer drum and the upper transport roll 62. As the receiver sheet passes through the transfer station, the bias on drum 72 is reversed, and the receiver sheet will receive registered toner images on the opposing surfaces thereof, one image being transferred from the web to the receiver sheet, and the other being transferred from the intermediate drum 72. Note, these images will be mirror images of each other due to the uneven number of times the two images have been transferred, and they will collectively provide the composite image described above. These toner images are fused to the receiver sheet by a pair of heated fusing rollers 74, and the resulting transparency is deposited in hopper 76. The web is then cleaned of residual toner by cleaning brush 79 and recycled through the recording process. This apparatus can be adapted for full color transparencies by transferring a plurality of color separated images to the intermediate drum, and then transferring this multicolor image to one side of the receiver sheet in registration with a monochrome image which is simultaneously transferred to the opposite side.

Figure 5:
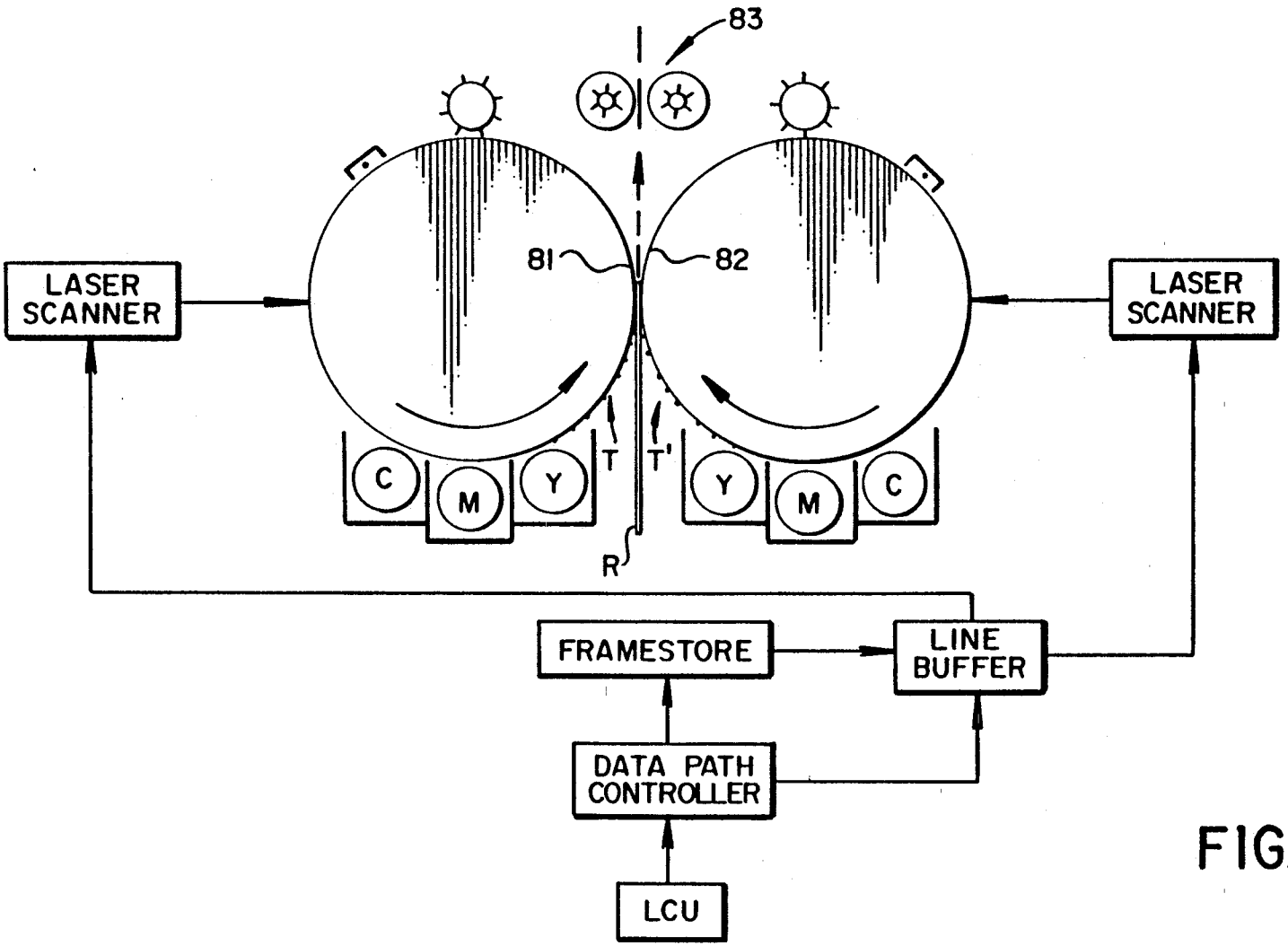

A further embodiment of the apparatus of the invention is illustrated in FIG. 5. Here, complementing toner images T,T' are formed on two photoconductive drums 81 and 82 in the manner described above. These toner images may be full color images composed of toner applied by cyan C, magenta M, and yellow Y toning brushes. These images are transferred simultaneously to opposite sides of the receiver sheet R, and the transferred images are fused to the receiver sheet by a pair of heated rollers 83.

The invention has been described with particular reference to preferred embodiments. It will be appreciated, however, that numerous modifications and variations can be made without departing from the true spirit of the invention. Such modifications and variations are intended to fall within the scope of the appended claims.

What is claimed is:

1. A method of producing a high density color transparency, said method comprising the steps of:

forming a first series of electrostatic images on an image member, toning the images of said first series of electrostatic images with different color dry toners to form a first series of different color dry toner images, transferring said first series of toner images to a first side of a transparent substrate in registration to form a first multicolor image, forming a second series of electrostatic images on the image member which images are a mirror image of the first series of electrostatic images, applying different color toner to the second series of electrostatic images to form a second series of different color toner images comparable to the first series of different color toner images, transferring the second series of different color toner images to a second side opposite the first side of the transparent substrate to form a second multicolor image in registration with the first multicolor image, and applying heat and pressure to each of the multicolor images to fix the images to the respective opposite sides of the substrate to form a color transparency with the first and second multicolor images collectively defining the density of a single multicolor image when viewed from one side of the substrate or when projected.

* * * * *